United States Patent [19]

Rix

[11] 4,387,501

[45] Jun. 14, 1983

[54] PALM GRIP APPARATUS FOR INSERTION OF WIRES

[75] Inventor: Robert D. Rix, Winston-Salem, N.C.

[73] Assignee: AMP Incorporated, Harrisburg, Pa.

[21] Appl. No.: 209,566

[22] Filed: Nov. 24, 1980

[51] Int. Cl.[3] ..... H01R 43/04

[52] U.S. Cl. ..... 29/566.4; 7/158; 29/33 M; 29/751; 29/752

[58] Field of Search ..... 29/566.4, 750, 751, 29/752, 33 M, 566.1, 566.2, 566.3, 753, 747, 748, 278; 72/452; 7/130, 131, 133, 134, 158

[56] References Cited

U.S. PATENT DOCUMENTS

| | | | |
|---|---|---|---|
| 736,964 | 8/1903 | Hanson . | |
| 2,812,676 | 11/1957 | Brown . | |
| 3,177,693 | 4/1965 | Batcheller . | |
| 3,611,782 | 10/1971 | Eppler | 29/751 X |
| 3,742,571 | 7/1973 | Brehm | 29/751 X |
| 3,774,284 | 11/1973 | Cootes | 29/751 |
| 3,838,491 | 10/1974 | Mayberry et al. | 29/750 X |
| 4,006,519 | 2/1977 | Long et al. | 29/749 |
| 4,023,450 | 5/1977 | Ygfors . | |
| 4,238,874 | 12/1980 | Chandler et al. | 29/33 M |

*Primary Examiner*—Z. R. Bilinsky
*Attorney, Agent, or Firm*—Gerald K. Kita

[57] ABSTRACT

The disclosure relates to apparatus for trimming and inserting insulated conductors into wire in slot, electrical terminals of a connector housing. The tool indexes to multiple positions along the housing and is designed for operation in the palm of a hand.

5 Claims, 7 Drawing Figures

Fig. 7
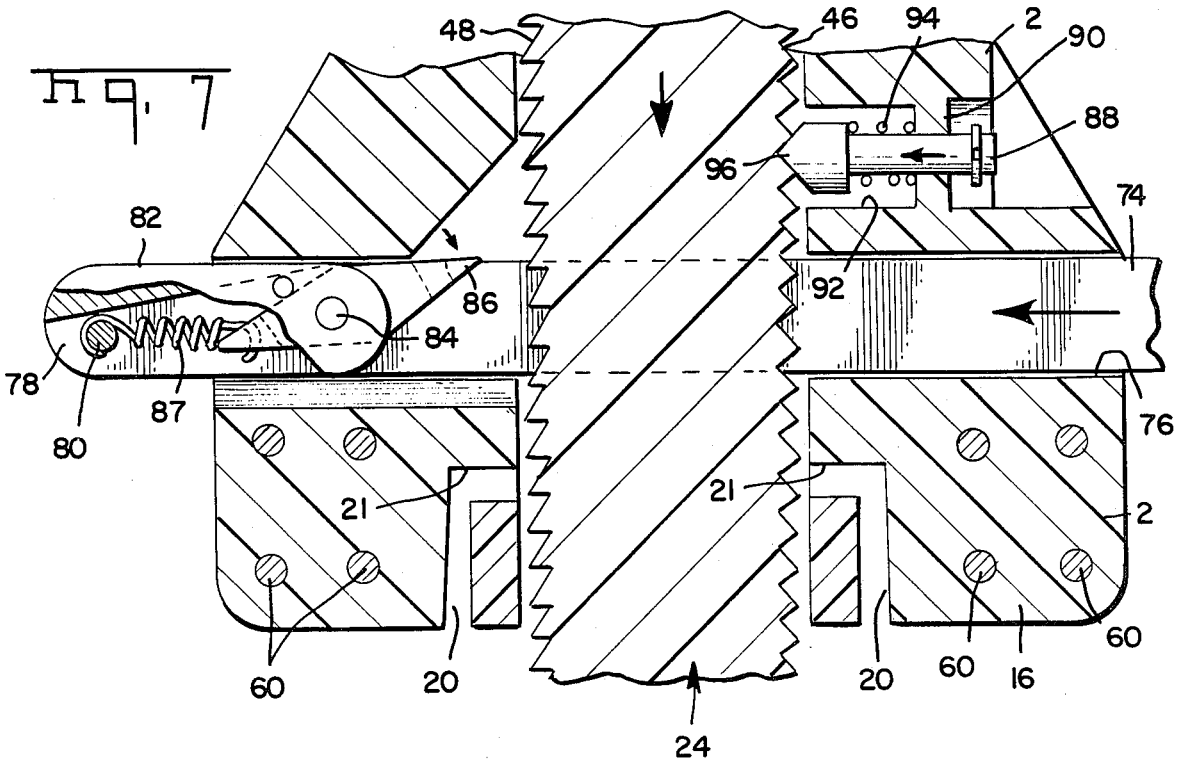
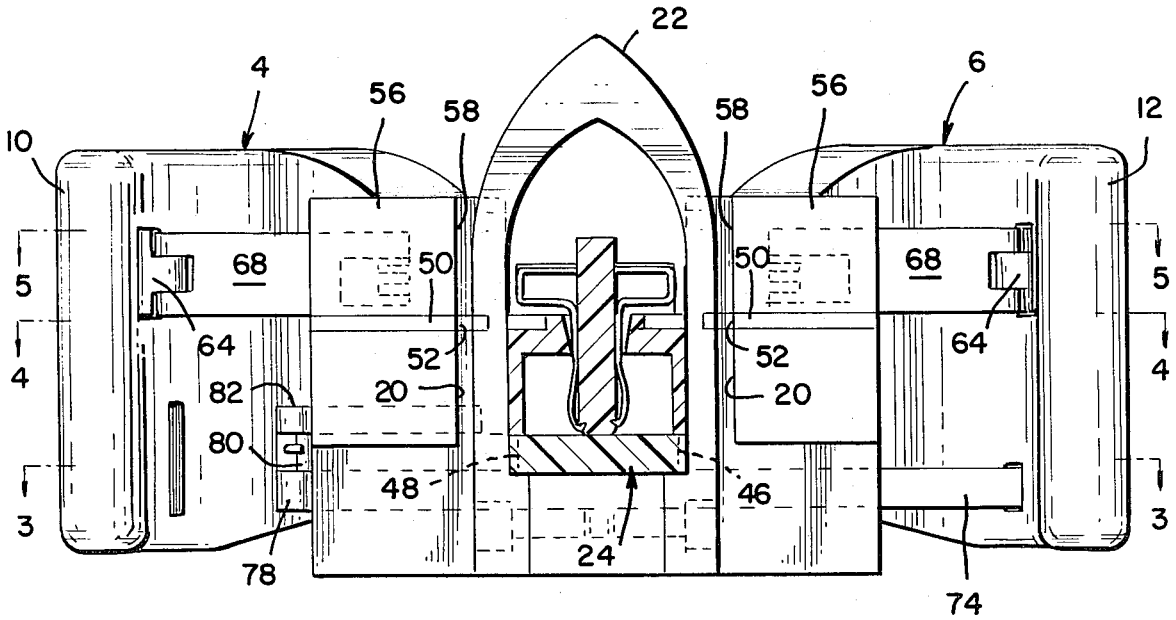
Fig. 2

8
8
4
6
34
28
18
32
36
34
32
48
46
30
60
60
44
44
14
10
12
56
54
56
50
74
82
72
80
66
70
70
64
68
64
62
69
60
58
44
44
69
60
16
66
62
68
58
26

62
66
68
64
70
68
66
62
64
50
50
28
34
34
32
30
52
54
52
36
24
26
48
46
96
88
82
84
86
74
94
78
80
87
72

PALM GRIP APPARATUS FOR INSERTION OF WIRES

FIELD OF THE INVENTION

The present invention relates to a tool for installing an electrical connector onto multiple wires of an electrical cable. The tool advantageously is gripped and operated in the palm of one's hand, and thereby is known as a palm grip tool.

BACKGROUND OF THE INVENTION

U.S. Pat. No. 3,838,491, discloses a palm grip tool for trimming wires and inserting the trimmed wires into terminals of a connector. A single wire only is installed with each actuation of the tool. The connector must be manually adjusted to position each additional terminal for connection to a corresponding wire.

SUMMARY OF THE INVENTION

A palm grip tool according to the invention trims and inserts one or a pair of insulated wires into respective terminals of an electrical connector, then automatically indexes the connector to position additional terminals in readiness for insertion of additional wires. Handles of the tool are resilient beams doubled back along themselves and are integral with the main body of the tool.

OBJECTS

An object of the present invention is to provide a palm grip tool which trims and inserts one of a pair of wires into terminals of an electrical connector, then automatically indexes the connector to position additional terminals in readiness for insertion of additional wires.

Another object is to provide a palm grip tool having handles in the form of resilient beams doubled back along themselves and integral with a main body of the tool.

Other objects and advantages of the present invention will become apparent from the following detailed description taken in conjunction with the drawings.

DRAWINGS

FIG. 2 is a front elevation partially in section of the tool shown in FIG. 1.

FIG. 3 is a section along the line 3—3 of FIG. 2.

DETAILED DESCRIPTION

Figure 1:
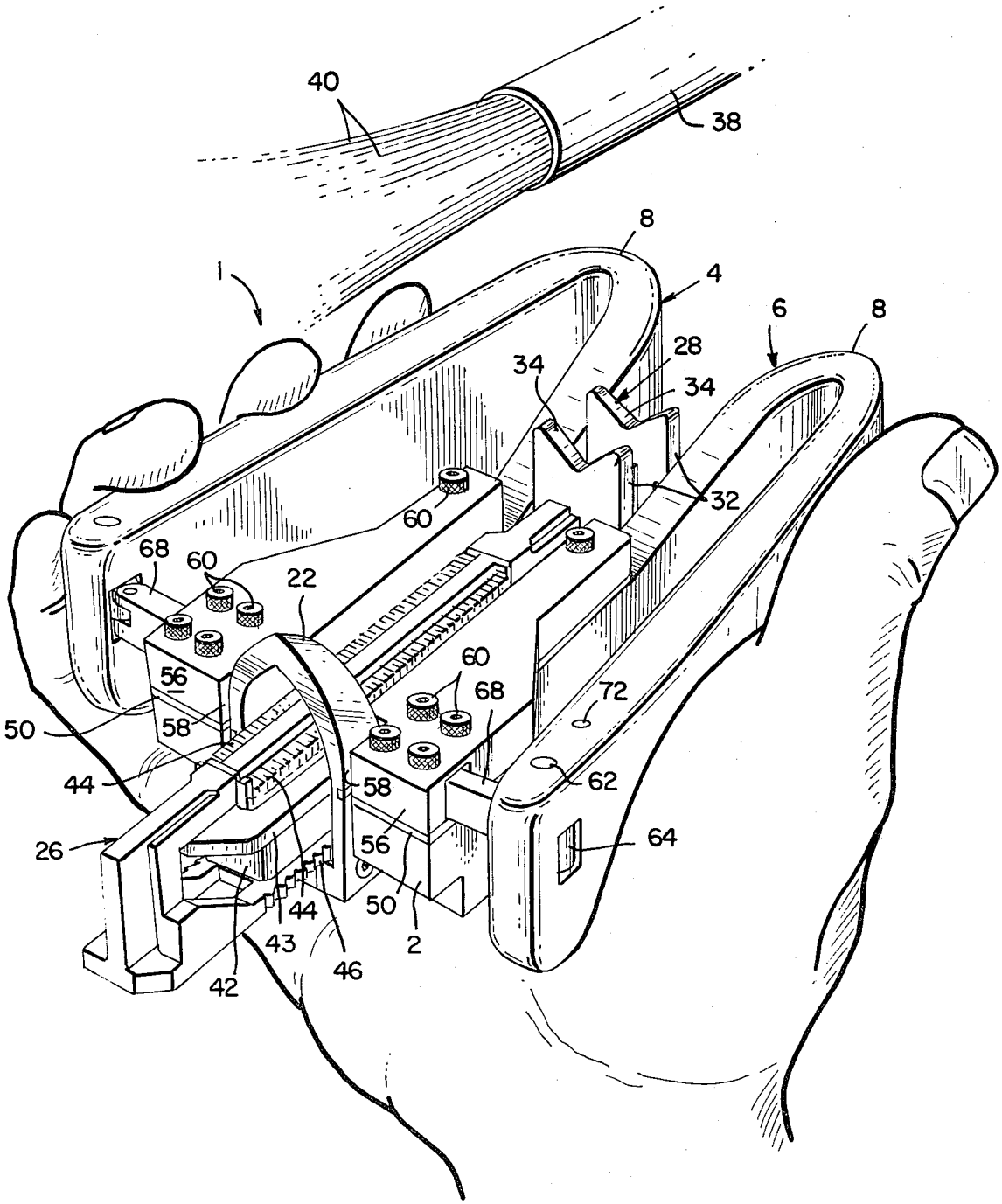
FIG. 1 is a perspective of a preferred embodiment of a palm grip tool according to the present invention.

More particular reference is made to FIGS. 1 and 3, wherein a palm grip tool 1 includes a main body 2 and integral resilient beams 4 and 6 doubled back along themselves at bight hinge portions 8 and providing elongated handles 10 and 12. The body and handles may be molded or machined from a plastic material which provides resiliency for the handles upon flexure about their hinge portions 8. The body 2 is provided with an elongated channel 14 from one end 16 of the body 2 to the other end 18. A pair of L-shaped wire receiving passageways 20 extend through the end 16 on either side of the channel 14. The ends 21 of passageways project toward and communicate with the channel 14. An arch shaped cusp 22 spans across the channel 14 and is secured to the end 16 in between and adjacent to respective sides of the passageways 20 where they communicate with end 16.

Figure 5:
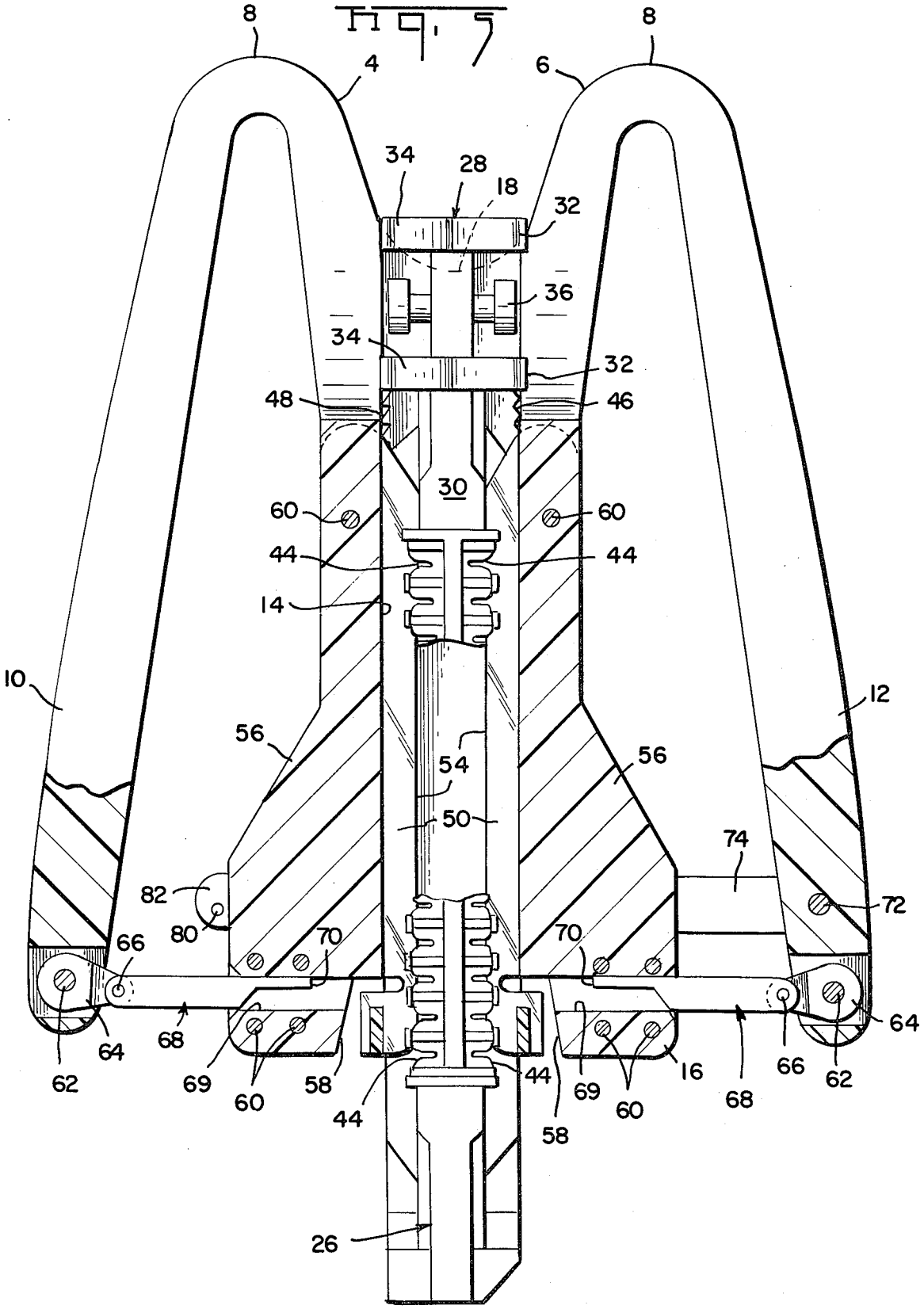
FIG. 5 is a section along the line 5—5 of FIG. 2.
Figure 6:
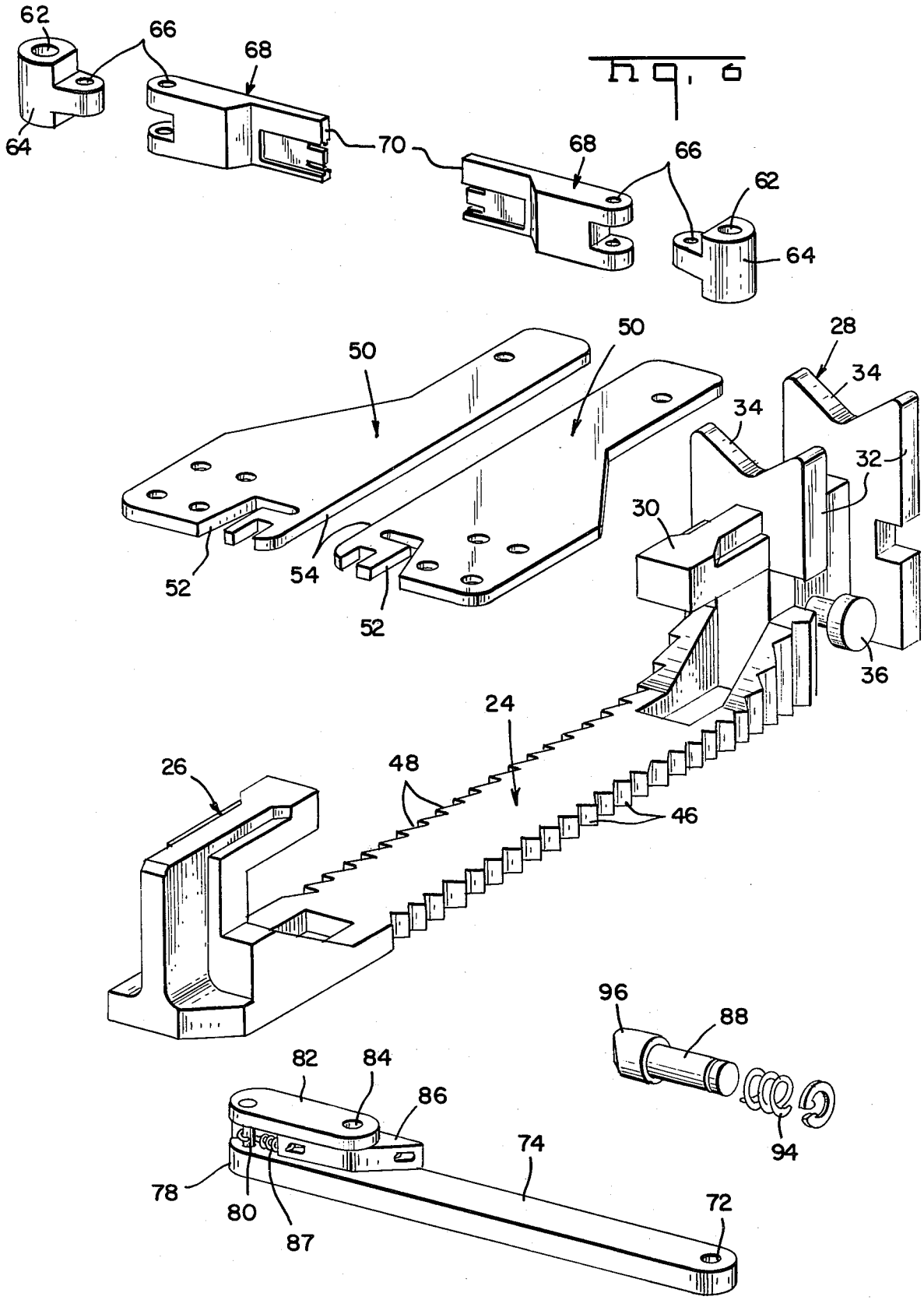
FIG. 6 is a perspective of selected component parts of the tool in exploded configuration.

FIGS. 5 and 6 illustrate an elongated carriage 24 slidably received in channel 14 and provided at one end with a projecting, inverted, L-shaped bracket 26. The other end of the carriage is provided with a bracket 28 having an inverted L-shaped portion 30, facing the bracket 26, and a pair of cable supporting flanges 32 having V-shaped recessed seats 34. Pegs 36 project from opposite sides of the bracket 28 to secure a tie strap, of the type disclosed in U.S. Pat. No. 3,838,491, issued Oct. 1, 1974, which is looped over a multiple conductor cable 38 to hold the same on the flanges 32.

The multiple insulated wire conductors 40 of the cable are to be connected in an electrical connector of the type fully disclosed in U.S. Pat. No. 3,760,335. For the purpose of this disclosure, the connector includes a molded plastic housing 42, shown in FIG. 1, with side flanges 43 and two rows of electrical terminals, the wire receiving and connecting portions 44 of which are in two rows along the connector housing. Each portion 44 is a U-shaped plate which has a wire receiving and connecting slot extending into the plate, the sides of the slot forming insulation penetrating and wire engaging jaws. When a wire is forcibly inserted transversely of its length into and along the slot, the jaw sides of the slot penetrate the insulation and resiliently engage opposite sides of the wire conductor to establish electrical connection therewith. This portion of terminal 44 is referred to generally as a wire in slot type.

Figure 4:
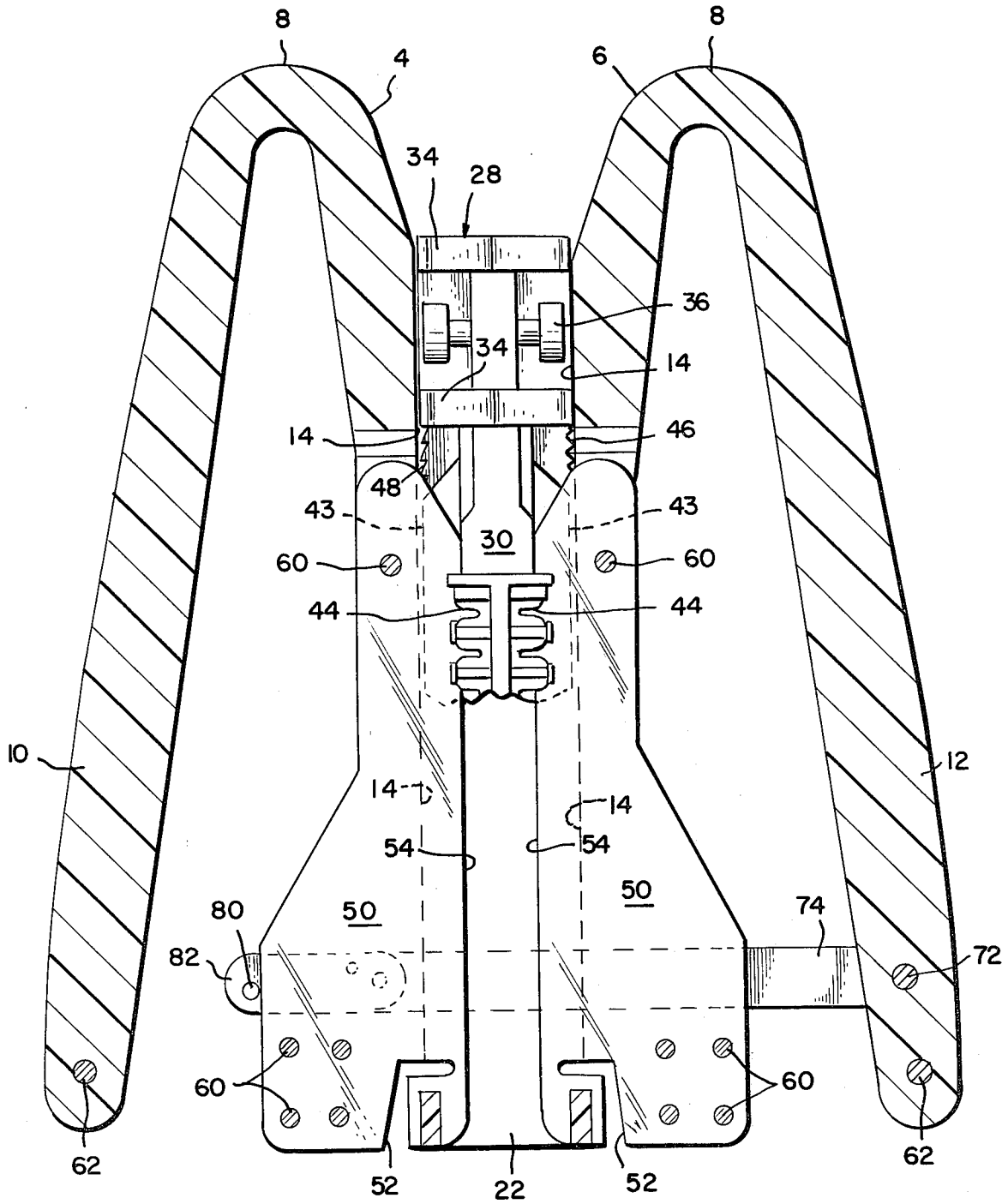
FIG. 4 is a section along the line 4—4 of FIG. 2.

As shown in FIG. 6, one side of carriage 24 is provided with a series of symmetrically sloped teeth 46. The other side is provided with a series of wedge sloped teeth 48. A pair of broad, flat, metal shear blades or plates 50 are provided with wire receiving passageways 52, similar to passageway 20, and side margins 54 which partially overhang sides of the channel 14 when the plates are mounted to body 2 as shown in FIGS. 2 and 4.

FIGS. 1, 2 and 5 show plastic blocks 56 which overlie respective plates 50 and are provided with wire receiving passageways 58 similar to and in alignment with passageways 52 and 20. Fasteners 60 secure body 2, plates 50 and blocks 56.

FIGS. 5 and 6 show the free end of each handle 10 and 12 pivotally pinned at 62 to a link 64, in turn, pivotally pinned at 66 to an inserter 68 slidably mounted in a respective cavity 69 in blocks 56.

Details of each inserter are shown in FIG. 6, as including, a wire engaging end 70 which is configured to push against a wire conductor and insert the same into a wire in slot portion 44.

Figure 7:
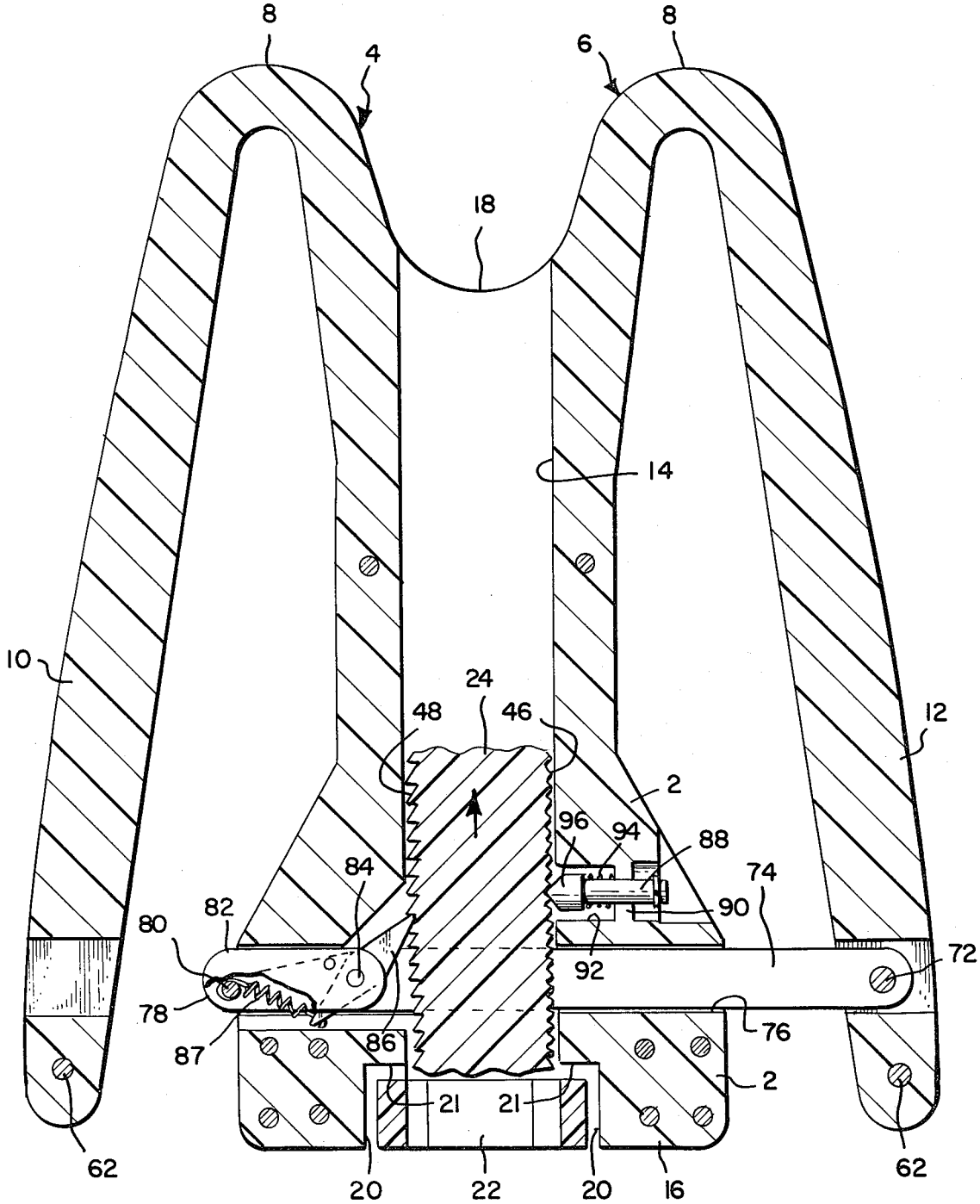
FIG. 7 is a fragmentary enlarged view of a portion of FIG. 3, illustrating an indexing mechanism in one stage of its operation.

FIGS. 3, 6 and 7 illustrate the handle 12 pinned at 72 to a link arm 74 that is slidably mounted in a passageway 76 passing entirely through body 2 and transverse to the long axis of the channel 14. Free end 78 of the arm 74 is pinned at 80 to one end of a link 82, the other end of which is pinned at 84 to a pivotally mounted feed pawl 86. Coil spring 87 is connected to one end of feed pawl 86 and pin 80. FIGS. 3 and 7 show the link arm 74 slidable back and forth along passageway 76 alternately to engage and disengage pawl 86 from between teeth 48, when carriage 24 is in channel 14.

FIGS. 3 and 7 show a locking plunger pawl 88 slidably mounted in a web 90 spanning a recess 92 of body 2. A coil spring 94 encircling the plunger pawl is compressed between the web 90 and an enlarged head 96 which has a doubly tapered tip for registration between teeth 46 of carriage 24.

In use, the connector housing 42 is placed lengthwise on the carriage with the bracket portions 26 and 30 overlying ends of the connector. The carriage is inserted into the channel 14 and is slid lengthwise of the channel until the terminal portions 44 nearest the bracket 26 are aligned with the ends 70 of the inserters 68 and with the wire receiving passageways 58. The plunger pawl 88 will engage between the teeth 46 and lock the carriage 24 momentarily in place. If sufficient force is applied lengthwise upon the carriage 24, the pawl 88 will be forced to retract against the resilient action of the spring 94, allowing the carriage to slidably displace lengthwise along the channel 14. When the carriage is stationary the pawl 88 once again will engage the teeth 46 momentarily holding the carriage in place. The carriage is held by the pawl 88 only if terminal portions 44 are in alignment with the inserter ends 70.

The cable 38 is seated and strapped down against the flanges 34, and the insulated conductors 40 of the cable project generally toward the body end 16. An operator selects a twisted pair of conductors 40 and separates them from each other by moving them against the projecting point of the cusp 22. In continuous motion, the separated individual wires are inserted through and along respective passageways 20, 52 and 58, on either side of the cusp and in alignment with the inserter ends 70.

With a pair of individual wires in respective passageways and in alignment with the inserter ends 70, the handles 10 and 12 are gripped as shown in FIG. 1 and are pivoted toward the body 2 and each other, causing the inserters 68 to traverse along cavities 69 and enter the ends of the passageways 58 to engage and push the respective conductors toward the terminal portions 44. Since the conductors extend also through the passageways 52 in the plates 50, they are sheared and trimmed to length as they are thrust by the inserter ends 70 across the surface of plates 50. The conductors are sheared at the sliding interface of each inserter end 70 and a respective plate 50. The trimmed conductors then continue to be thrust by the inserter ends 70 until they are inserted transversely of their lengths into the terminal portions 44. Since these terminal portions are of the wire in slot type, electrical connections occur simply upon insertion of the conductors into the terminal portions. The handles 10 and 12 are released, allowing their stored resilient spring energy to return the handles to their original positions, for example, shown in FIG. 5.

FIGS. 3 and 7 illustrate indexing of the carriage 24. When the handles are pivoted to insert the conductors into the terminals, FIG. 7 shows the link 74 being displaced to disengage pawl 86 from teeth 48. The disengaged pawl will be pivoted clockwise by the pulling action of the stored energy in spring 87. When the handles 10 and 12 are released, the feed pawl will engage the teeth 48 as shown in FIG. 3. The return motion of handle 12 will urge the feed pawl with sufficient force against the teeth 48, that the pawl will pivot counterclockwise as the distance between the pin 84 and the carriage 24 is narrowed. This pivoting of the feed pawl stretches and stores energy in the spring 87 and forcibly displaces the carriage 24 along the channel 14 to a new position. The pawl 96 will engage the teeth 46 to retain the carriage in its new position. In its new position the carriage will locate an additional terminal portions 44 alignment with the inserter ends 70. The tool actuation is repeated as required to trim and insert wires into the additional terminal portions 44. Either a single wire or a pair of wires are installed by use of the tool 1.

Although a preferred embodiment is disclosed, other embodiments and modifications of the present invention which would be apparent to one having ordinary skill are intended to be covered by the spirit and scope of the present invention.

What is claimed is:

1. An apparatus for cutting and inserting a pair of wires into electrical terminals of an electrical connector, and for indexing the connector, the improvement comprising:

a body, a carriage movable with respect to said body, a cusp mounted on said body and defining wire receiving slots on either side thereof, a pair of wire insertion and cutting rams mounted for reciprocation in said body, toward and away from opposite sides of said carriage, resilient levers connected to said body and doubled back on themselves and pivotally connected to said rams, a feed pawl engaged on said carriage and pivotally secured on an arm, in turn, reciprocably mounted on said body and secured to one of said levers, and a locking pawl reciprocably mounted on said body for releasable engagement on said carriage.

2. The structure as recited in claim 1, in which said locking pawl engages one side of said carriage, and said feed pawl engages an opposite side of said carriage.

3. The structure as recited in claim 1, and further including: a shear blade mounted to said body in alignment with each said wire receiving channel.

4. A hand tool for severing and inserting pairs of wires successively into pairs of terminals, the terminals of each pair being arranged in rows on respective opposite sides of an electrical connector, the hand tool comprising a body formed with a channel receiving a connector carriage for movement therealong and a pair of resilient handles integrally connected to one end of the body on opposite sides of the channel by respective web hinge portions to extend along the body spaced therefrom with free ends of the handles adjacent the other end of the body, a wire guiding cusp on the other end of the body defining wire receiving slots on respective opposite sides, a pair of wire insertion and severing rams mounted in the other end of the body for reciprocation transversely of the channel and a carriage indexing means including a feed pawl carried by an arm portion connected to one of the handles, the arrangement being such that movement of the handles towards and away from the body between flexed and unflexed conditions operates the wire insertion and severing rams and indexing means alternately, with the restoring force in the flexed handles effecting their movement away from the body.

5. A hand tool according to claim 4 in which the restoring force in the one handle effects connector indexing movement of the feed pawl.

* * * * *